US006948930B2

(12) United States Patent
Brzoska et al.

(10) Patent No.: US 6,948,930 B2
(45) Date of Patent: Sep. 27, 2005

(54) FURNACE HEAD OR FURNACE THROAT SEAL

(75) Inventors: Ekkehard Brzoska, Mülheim (DE); Franz-Josef Irnich, Hürtgenwald (DE); Friedhelm Paulus, Hürtgenwald (DE)

(73) Assignee: Z&J Technologies GmbH, Duren (DE)

( * ) Notice: Subject to any disclaimer, the term of this patent is extended or adjusted under 35 U.S.C. 154(b) by 0 days.

(21) Appl. No.: 10/872,185

(22) Filed: Jun. 18, 2004

(65) Prior Publication Data

US 2004/0265766 A1 Dec. 30, 2004

(30) Foreign Application Priority Data

Jun. 20, 2003 (DE) ..... 103 27 931
Jul. 28, 2003 (DE) ..... 103 34 417

(51) Int. Cl.[7] ..... F27D 1/04
(52) U.S. Cl. ..... 432/95; 432/96; 266/197
(58) Field of Search ..... 432/95, 96, 87; 266/197, 199; 414/206, 208

(56) References Cited

U.S. PATENT DOCUMENTS 4,094,494 A * 6/1978 Mahr ..... 266/44
4,243,351 A * 1/1981 Legille et al. ..... 414/206
4,273,492 A * 6/1981 Legille et al. ..... 414/160
4,322,197 A * 3/1982 Mahr et al. ..... 414/206
4,514,129 A * 4/1985 Legille et al. ..... 414/200
5,022,806 A * 6/1991 Lonardi et al. ..... 414/208
5,738,822 A * 4/1998 Lonardi et al. ..... 266/199
5,829,968 A * 11/1998 Lonardi et al. ..... 432/95
6,004,090 A * 12/1999 Axelsson ..... 414/206
6,261,513 B1 * 7/2001 Bernard et al. ..... 266/92
6,481,946 B1 11/2002 Lonardi et al.
6,580,744 B1 * 6/2003 Irnich ..... 373/79

FOREIGN PATENT DOCUMENTS

| | | |
|---|---|---|
| DE | 868913 | 3/1953 |
| DE | 1169474 | 5/1964 |
| DE | 27 31 405 | 2/1978 |
| DE | 29 29 204 C2 | 11/1987 |
| DE | 33 42 52 C2 | 7/1992 |
| DE | 295 15 419 U1 | 1/1996 |
| DE | 199 29 180 C2 | 8/2001 |
| EP | 0 065 084 B1 | 3/1982 |
| JP | 59107010 A | 6/1984 |
| JP | 07062411 A | 3/1995 |
| WO | WO 02/24962 A1 | 3/2002 |
| WO | WO 03/050314 A1 | 6/2003 |

* cited by examiner

*Primary Examiner*—Gregory A. Wilson
(74) *Attorney, Agent, or Firm*—Andrus, Sceales, Starke & Sawall, LLP

(57) ABSTRACT

A blast furnace head (11) including a material loading device comprising rotary chute (14) driven in rotation about a first, vertical axis of rotation (16), and a loading chute (15) at the outlet of same, driven in rotation about a second, vertical axis of rotation (17) laterally offset relative to the first axis of rotation (16). The gears (20, 21) assigned to both of the chutes (14, 15) are arranged within a sealing chamber (22). Within this sealing chamber (22), a means (28) is arranged for supplying integrated measuring devices (29 or 30), lubrication points or similar maintenance recipients, with these supply means (28) being drivable by one of the gears (20, 21) assigned to the two chutes, in particular by the gear (20) assigned to the rotary chute (14).

9 Claims, 2 Drawing Sheets

FURNACE HEAD OR FURNACE THROAT SEAL

CROSS REFERENCE TO RELATED APPLICATION

Figure 1:
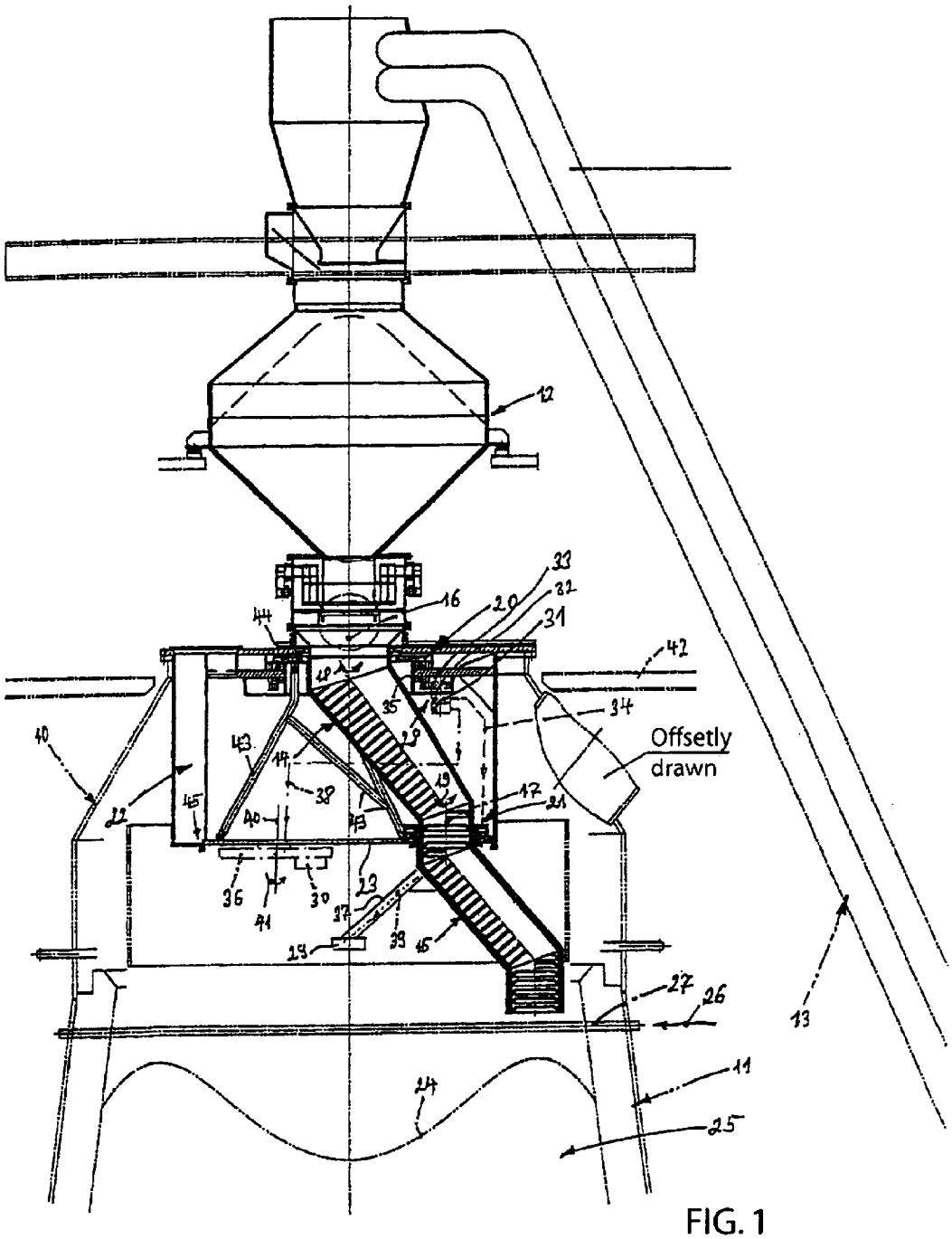

The present application claims priority from German Application No. 103 27 931.8 filed on Jun. 20, 2003 and German Application No. 103 34417.9 filed on Jul. 28, 2003.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

The invention relates to a furnace head or furnace throat seal according to the preamble of claim 1 or the preamble of claim 2.

For loading (charging) shaft or blast furnaces with a charge, a plurality of various charging devices are known. In order to distribute the charge uniformly over the shaft cross-section, rotatable furnace throat seals including an equally rotatable distributor arranged eccentrically to the furnace axis were, in particular, already proposed decades ago. With such a charging device, a high degree of uniform loading may take place without formation of accentuated bulk cones, in that the orifice of the distributor is guided over the shaft cross-section on two superimposed circular paths.

From document EP 00 65 084 B1, a rotary chute is known, which may be pivoted about two axes that are orthogonal to each other. One of the axes about which the chute may be pivoted, is the chute's suspension axis; the second axis is the chute's longitudinal axis. This device is intended to enable a furnace to be uniformly loaded, there being no possibility in such a rotary chute to control the uniformity of the loading.

A somewhat different arrangement from that known from document DE 295 15 419 U1 comprises a rotary chute having a rotatingly drivable cylindrical housing, several loading chutes which have different radial extensions and are connected to the outlet of the housing, and a distributing chute arranged inside the housing, the end of which chute opens into a loading chute and being rotatable with the housing, with the distributing chute inside of the housing being adjustable, and the assignment to the loading chutes being selectable. With this arrangement, the charging profile may be purposely adjusted; however, it is relatively expensive as far as construction and cost of materials are concerned.

From document DE-PS 868 913, differently configured charging devices for blast furnaces are known, the core part of which are a first hopper having a trunk-shaped outlet guiding the material to be brought to the edge of the furnace, and a second hopper having a perpendicular outlet, which feeds the charging material towards the center of the furnace. Also this arrangement is characterized by a high material expenditure; and, in addition, enables a desired adjustment of the charging profile from various charging materials in only a very restricted manner.

A further rotatable charging device known from document DE-AS 1 169 474 comprises a plurality of distributing chutes spread over the periphery of a circle, and, in addition, a distributing chute close to the center and an outer distributing chute, which are all filled by an appropriately guided hopper chute. In this arrangement, a freely selectable adjustment of the orifice towards a desired point of the shaft cross-section is not possible; and this device is also expensive as far as construction and materials are concerned.

Finally, reference is made to the charging device according to the document DE 199 29 180 C2 originating from the Applicant. This charging device is space-saving and material-saving. It enables an extremely uniform distribution of the material in the furnace throat or the furnace shell of the blast furnace.

BRIEF SUMMARY OF THE INVENTION

Starting from this state of the art, the present invention is based on the object of creating a furnace head with a functionally safe material charging device, whose functioning may also be checked, if required.

This object is achieved by the characterizing features of claim 1 or claim 2.

One solution for the object results from the fact that, if only one rotary chute is present, a device is provided which supplies measuring devices, lubrication points or similar maintenance recipients arranged in the active area of the rotary chute, this supply device being drivable by a gear assigned to the rotary chute, said gear thus having a multiple function. To be more precise, it serves in addition for channelling off energy for measuring devices, lubricant pumps or similar. The channelling off of energy preferably takes place inside of an enclosed housing which may be acted upon by flushing gas, if required.

As an alternative, in an arrangement of a rotary and distributor chute or loading chute, the supply means may be driven by one of the gears assigned to the two chutes, in particular by the upper gear assigned to the rotary chute. The two gears assigned to the chutes, as well as the supply means are preferably situated inside of a dustproof and heatproof sealing chamber, thus ensuring an extremely compact and also functionally safe supply to measuring devices, lubrication points or similar over a long period. The supply means are either a dynamo supplying a measuring device with current and/or a lubricant pump supplying the two gears with lubricant, in particular the lower one assigned to the loading chute from the upper gear assigned to the rotary chute. Above all, the lubricant supply to the gear situated closer to the loading material or the lower gear is extremely critical due to the high temperatures prevailing there. Without an active lubricant supply, there would be a risk of the gear, as a rule a toothed gear, running dry and being subjected to increased wear and tear. Thanks to the lubricant supply of the invention, as well as the arrangement of the gear inside of a sealing chamber which ensures dust protection, the wear and tear of the gear may be considerably reduced resulting in a correspondingly longer lifetime. Here it has to be added that the sealing chamber is preferably acted upon by a flushing gas so as to ensure a dust-free zone within the chamber.

The measuring device advantageously is disposed at the lower side of the sealing chamber facing the furnace throat of the blast furnace, in particular on an arm or a disk rotatably mounted there. A particularly elegant, since constructionally simple, solution consists in arranging the measuring device on an arm connected to the rotatingly driven loading chute. Because of this, a separate rotary drive for the measuring device is no longer necessary, insofar as such a rotary drive is considered as being necessary for "sweeping" or detecting the entire cross-section of the shaft furnace by means of the measuring device in the desired manner.

The measuring device may have IR (infrared) sensors, temperature sensors and/or radar probes. These serve for measuring the surface profile of the material filled in (profile meter) and/or for measuring the temperature, pressure, gas composition or similar within the material loading chamber or in the furnace throat.

In order to ensure the power supply of the measuring device even during a standstill of the rotary chute, the power supply preferably takes place via a buffer battery that is charged by the above-mentioned dynamo if required.

Due to the extremely hot, aggressive and dusty environment of the measuring device, it may be advisable to carry out the transmission of the measuring signals generated by the measuring device in a wireless manner to an evaluation and display means, in particular a monitor, arranged outside the furnace head.

A particularly failsafe and wear-free energy supply of the measuring device, as well as a reliable data transfer is facilitated by a construction which transmits the required energy as well as the data by way of induction. Due to the fact that the transmission takes place contactless, a high resistance to interference may be achieved. With this construction, one can dispense with batteries and/or a generator or dynamo.

BRIEF DESCRIPTION OF THE SEVERAL VIEWS OF THE DRAWING(S)

Figure 2:
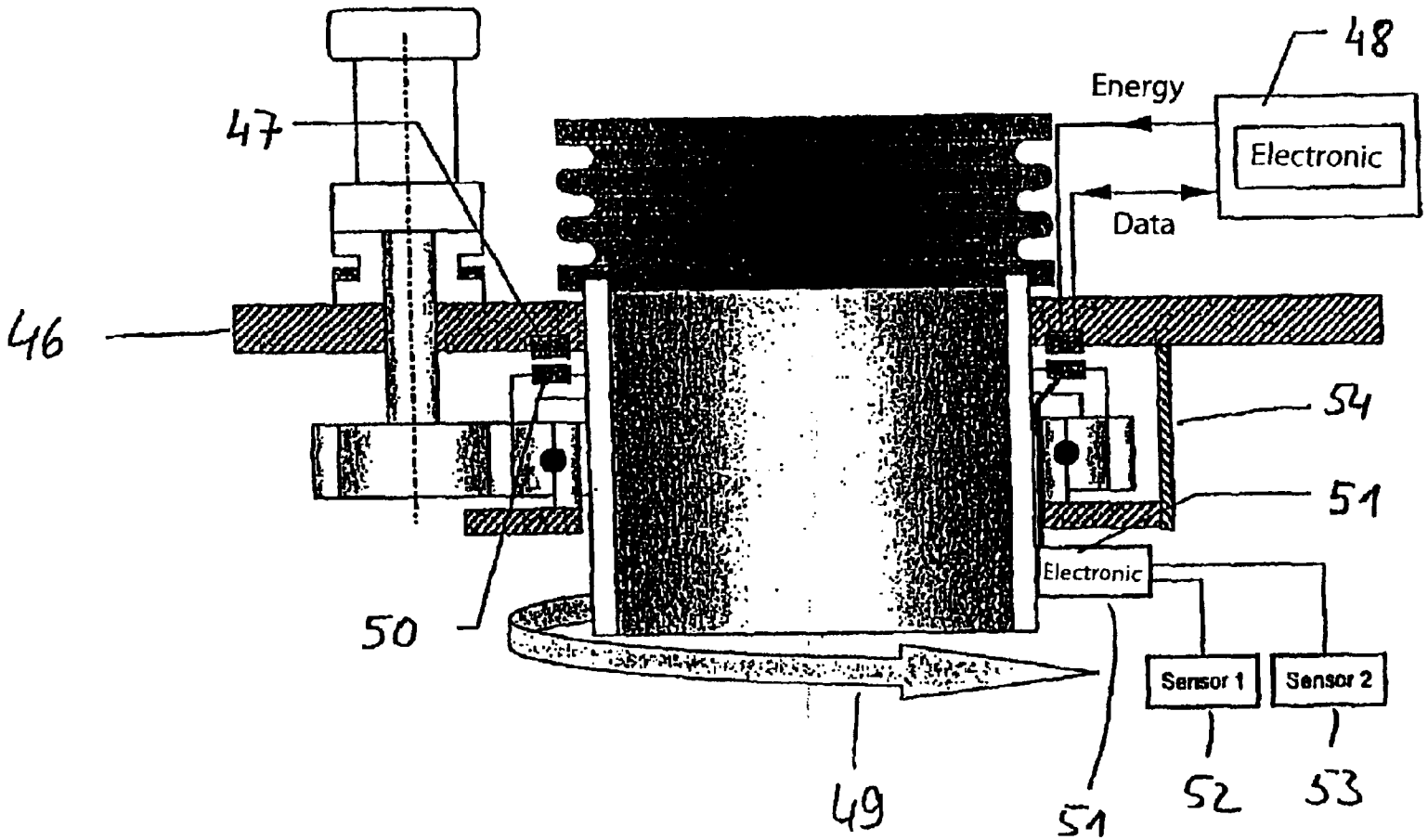

An embodiment of a furnace head configured according to the invention will be described in more detail below by means of the accompanying drawings, which show in FIG. 1 in a schematic longitudinal section, a furnace head with a material bunker arranged above it; and FIG. 2 a preferred means for an energy and/or data transfer between an energy/data source and a measuring device (sensors) within a construction according to FIG. 1 in a schematic cross-section and enlarged scale.

DETAILED DESCRIPTION OF THE INVENTION

The furnace head is designated in the attached drawing by reference numeral 10. This furnace head is located above the furnace shell 11 or furnace throat of a blast furnace not shown in more detail. Above the furnace head, a so-called material bunker 12 is placed, into which a bulk material is filled via a conveying arrangement 13. From the material bunker 12 the loading of the furnace throat 11 via a rotary chute 14 and distributor or loading chute 15 then takes place. The rotary chute 14 is rotatingly driven about a first axis of rotation 16. At the outlet, i.e. at the lower end of the rotary chute 14, the distributor or loading chute is mounted driven in rotation about a second, vertical axis of rotation 17 laterally offset relative to the first axis of rotation 16. The respective rotary movements of the aforementioned chutes are indicated by the arrows 18, 19.

The rotary drive of both of the chutes 14, 15 is effectuated by assigned gears 20, 21 arranged within a cup-like sealing chamber 22 for reasons of temperature and dust protection. The upper gear 20 assigned to the rotary chute 14, is in addition coupled to an electromotive drive, not shown in more detail here. Furthermore, the transmission of the rotary movement to the lower distributor and loading chute 15 takes place relative to the obliquely directed rotary chute 14 via a gear connection, also not shown in more detail here, between the gear 20 assigned to the rotary chute 14 and the gear 21 assigned to the loading chute 15. Reference is made in this respect to the construction described in DE 199 29 180 C2.

The lower side of the sealing chamber 22 is closed by a particularly heat-resistant plate 23. This plate represents a kind of heat shield. It also surrounds the housing of the gear 21 assigned to the loading chute 15.

Here, it should also be noted that conventionally, the measurement of the surface profile 24 of the material 25 filled into the furnace throat 11 is carried out by means of a sublance which may be introduced laterally at the upper side of the furnace throat. Accordingly, passage openings are required at the upper end of the furnace throat for introducing the sublance in the direction of the arrow 26. The sublance 27 is indicated by reference numeral 27 in the attached drawing. It is apparent that this kind of measurement is laborious. In particular, it is also unpleasant for the service personnel due to the fact that the sublance must be manually introduced at the upper end of the furnace throat of a blast furnace. During the introduction or withdrawal of the sublance, material will flow over the lance, which leads to wear and tear. Also, leakages are unavoidable, which are unpleasant for the service personnel and may in extreme cases even lead to injuries. Moreover, conventional sublances do not allow a precise detection of the edge areas of the furnace throat. These are often in the shadow of material heaps. Accordingly, there is a strong need for placing measuring devices in the furnace head. Furthermore, such measuring devices of course need to be supplied with current.

Also the lubricant supply of the gears assigned to the chutes 14, 15, in particular of the lower gear assigned to the chute 15, is a practical concern in order to ensure permanently secure operation. In the illustrated embodiment, a means 28 is arranged inside of the sealing chamber 22 for supplying an integrated measuring device 29 or 30, lubrication points, e.g. the lower gear 21, or similar maintenance recipients, with this supply means 28 being driven by the upper gear 20 assigned to the rotary chute 14. In the present case, the supply means 28 comprises a dynamo 31, as well as a lubricant pump 32. The dynamo, as well as the lubricant pump are connected to the gear 20 assigned to the rotary chute 14 via suitable gears. This gear connection is outlined in the attached drawing by the toothed wheel or pinion 33.

The lubricant supply of the lower gear 21 assigned to the loading chute 15 from the gearbox of the upper gear 20 via the supply line 34 is also outlined. This supply line is fed via the lubricant pump 32 from the housing 35 of the gear 20 assigned to the rotary chute 14.

The measuring device 29 or 30 is disposed at the lower side of the sealing chamber 22 facing the furnace throat 11 of the blast furnace, and, i.e., either on a disk 36 mounted there in a rotatable manner, or, preferably, on an arm 37 connected to the rotatably driven loading chute.

The power supply between the dynamo 31 and the measuring device 29 or 30 is outlined by respective power lines 38 or 39.

The disk 36 rotatably mounted at the lower side of the heat shield 23 is rotatably mounted about a vertical axis 40 (arrow 41). The rotary drive either takes place via an electric motor arranged at the inner side of the heat shield 23, and also fed by the dynamo 31, or by an additional gear connection with the gear 20 assigned to the rotary chute 14. Also, a gear connection between the gear 21 assigned to the loading chute 15, and the rotary disk 36 is conceivable.

In order to avoid these gear connections, it is, of course, particularly advantageous to connect the measuring device 29 to the loading chute 15, which is in any case driven in rotation about the vertical axis 17. Similarly, the measuring device 29 would then rotate about the axis 17, with this rotary movement being superimposed by the rotary movement of the rotary chute 14 about the center axis 16, so that a complete scanning of the cross-section of the furnace throat 11 by the measuring device 29 is achieved. The case is similar with the measuring device 30, since the disk 36 rotates about the axis 40, as well as about the axis 16 together with the heat shield 23. Hence, the measuring device 30, too, makes two superimposed rotary movements. It should be noted here that the heat shield 23 is rotatably mounted about the vertical axis 16 with the rotary chute 14.

As already mentioned at the beginning, the measuring device 29 or 30 comprises IR sensors, temperature sensors, pressure sensors and/or radar probes. By means of these sensors or probes, the surface profile 24 of the filling material 25 filled may be completely sampled. In addition or as an alternative, it is also possible to determine the temperature, pressure, gas composition, etc. in the material loading chamber or the furnace throat 11. For the reasons mentioned at the beginning, the power supply of the measuring device 29 or 30 preferably takes place via a buffer battery.

The transmission of the measuring signals generated by the measuring device 29 or 30 to an evaluation and display means arranged externally of the furnace head, may take place in a wireless manner. Likewise, of course, a conventional transmission of the measuring signals is possible, particularly since it is anyway necessary to ensure the power supply of the measuring device from the dynamo 31 (power lines 38 or 39) via cables.

It may be seen that the supply means 31, 32, as well as the supply lines 34, 38, 39 are arranged in a temperature-proof and dust-proof manner. Accordingly, the described construction is distinguished by a high degree of operational reliability over a long lifetime. Access to the furnace throat below the so-called platform 42 on the level of the upper side of the furnace head 10 is not required. All of the inspections, replacement works and repairs may be carried out from the above-mentioned platform 42, and, to be more precise, from the upper side of the sealing chamber 22. For this purpose, a so-called manhole is provided in the upper cover of the furnace head 10, or in the sealing chamber 22 inserted into the furnace head, through which manhole the sealing chamber 22 is accessible. As already mentioned, the sealing chamber is protected from dust and overly high temperatures from the furnace throat 11.

At this point it should be noted that, in the present case, the configuration of the sealing chamber 22 is also claimed as an invention, and, to be more precise, independently from as well as dependent on the supply means 28. Reference has already been made at the beginning to the advantageous effect of the sealing chamber as a dust and temperature protection. Furthermore, it has been pointed out above that the heat shield 23 together with the rotary chute 14 rotates about the vertical axis 16. For this purpose, linking rods 43 are provided between the heat shield 23 and a ring disk 44 also co-rotating with the rotary chute 14 about the axis 16. The ring disk 44 extends around the rotary chute 14 in the area of the gear 20 assigned to the rotary chute 14. The heat shield 23 also surrounds the gear 21 assigned to the loading chute 15. Accordingly, the loading chute 15 rotates together with the heat shield 23 about the first, vertical axis 16, on the one hand, and also in addition about the second, vertical axis 17, on the other hand. The heat shield 23 is mounted on the edge side at the lower opening edge of the preferably cylindrical sealing chamber 22 in a fluid-tight manner. The corresponding rotary plain bearing is outlined in the attached drawing by reference numeral 45.

According to a preferred embodiment, the energy supply of the measuring device and the data transfer from and to it takes place by induction. The appertaining structure is shown in FIG. 2. At an upper, stationary flange plate 46, e.g. the upper cover of the furnace head or the so-called furnace throat, an upper coil 47 is arranged, which is supplied with energy and/or data by corresponding electric and/or electronic components 48 (hereinafter called electronics 48 for short). At a rotating part (illustrated by the arrow 49) of the furnace head, a lower coil 50 is arranged separated from the upper coil 47 by an air gap. The upper coil 47 that is fed, as already mentioned, with energy and data by the electronics 48, transmits the energy/data inductively to the lower coil 50. The thus transmitted energy/data are used as voltage supply or energy supply for electric or electronic components 51 (hereinafter called electronics 51 for short) and sensors 53, which are arranged at the rotating part of the furnace head. Because of this, batteries and/or generators become superfluous, a fact that reduces maintenance work on the furnace head.

The measurement data of the sensors 52, 53 are prepared in the electronics 51 and inductively transmitted via the lower coil 50 to the upper coil 47. For further processing, they are subsequently forwarded to the electronics 48, which evaluates the data and makes it available to evaluation means arranged downstream as a standard signal for further processing. In the same way, data is transmitted from the electronics 48 to the electronics 51, which may, for example, include instructions and software or software updates for the sensors 52, 53 or the electronics 51. This bidirectional data flow ensures a high flexibility of the arrangement.

The upper and the lower coils 47, 50 are arranged within a housing 54 protecting the coils from the aggressive atmosphere within the furnace throat. At this point, it should be noted that the housing 54 also encloses the rotary drive and/or the gear connection between the rotary drive and the lower coil 50 (only shown in part in FIG. 2). Thus, the aforementioned components are protected by a housing. This housing, too, may be acted upon with flushing gas in order to keep the interior dust-free.

As an alternative, it is also conceivable that the individual components, i.e. the coils, the rotary drive and/or the gear connection between the rotary drive and the lower coil 50 are each protected by separate housings, if this may be more easily realized in the respective construction of the furnace head.

All of the features disclosed in the application documents are claimed as being invention-relevant, individually or in combination, to the extent that they are novel with respect to the prior art.

LIST OF REFERENCE NUMERALS

10 furnace head
11 furnace shell (furnace throat)
12 material bunker
13 conveying arrangement
14 rotary chute
15 loading chute
16 axis of rotation
17 axis of rotation
18 arrow

19 arrow
20 gear
21 gear
22 sealing chamber
23 plate or heat shield
24 surface profile
25 material
26 arrow
27 sublance
28 supply means
29 measuring device
30 measuring device
31 dynamo
32 lubricant pump
33 pinion
34 lubricant supply line
35 housing
36 disk
37 arm
38 power line
39 power line
40 axis
41 arrow
42 platform
43 linking rods
44 ring disk
45 rotary plain bearing
46 flange plate
47 upper coil
48 electric and electronic components
49 arrow
50 lower coil
51 electric and electronic components
52 sensor
53 sensor
54 housing

What is claimed is:

1. A furnace head (11) including a material loading device comprising a rotary chute (14) driven in rotation about a first, vertical axis of rotation (16), and a distributor or loading chute (15) driven in rotation about a second, vertical axis of rotation (17) laterally offset relative to the first axis of rotation (16), characterized in that a means (28) is provided for supplying measuring devices (29 or 30), lubrication points or similar maintenance recipients arranged in the active area of the rotary and/or distributor chute, with said supply means (28) being drivable by one of the gears (20, 21) assigned to the two chutes, in particular by the gear (20) assigned to the rotary chute (14).

2. The furnace head according to claim 1, characterized in that the supply means (28) is a dynamo (31) supplying a measuring device (29 or 30) with current, and/or a lubricant pump (32) supplying both of the gears (20, 21) with lubricant, in particular the lower gear (21) assigned to the loading chute (15) from the housing (35) of the upper gear (20) assigned to the rotary chute (14).

3. The furnace head to claim 1 characterized in that the measuring device (29 or 30) is arranged at the lower side of the sealing chamber (22) facing the furnace throat (11) of the blast furnace, in particular on a rotatably mounted arm or disk (36), preferably on a cantilever or arm (37) connected to the rotatably driven loading chute (15).

4. The furnace head according to claim 1, characterized in that the measuring device (29 or 30) comprises IR sensors, temperature sensors, pressure sensors and/or radar probes serving measurement of the surface profile (24) of the filling material (25) and/or measurement the temperature, pressure, gas composition or similar in the material loading chamber or in the furnace throat.

5. The furnace head according to claim 4, characterized in that the power supply of the measuring device (29 or 30) takes place via a buffer battery.

6. The furnace head according to claim 5, characterized in that the transmission of the measurement signals generated by the measuring device (29 or 30) to an evaluation and display means (monitor) arranged outside the furnace head (11) takes place in a wireless manner.

7. The furnace head according to claim 6, characterized in that the energy supply of the measuring device and/or the data transfer to and from the measuring device takes place by induction.

8. The furnace head according to claim 7, characterized in that on a stationary flange plate, on the one hand, and a rotating part of the furnace head, on the other hand, in each case coils (47, 50) are arranged separated from each other by an air gap and each being connected to electric and/or electronic components (48, 51).

9. The furnace head according to claim 8, characterized in that the coils (47, 50) are arranged within a housing (54) protecting the coils, as well as, if existing, the rotary drive and/or the gear connections between the rotary drive and the coil (50) from the aggressive atmosphere within the furnace throat.

* * * * *